US006646654B2

(12) United States Patent
Takagi

(10) Patent No.: US 6,646,654 B2
(45) Date of Patent: Nov. 11, 2003

(54) MODULATION CIRCUIT, IMAGE DISPLAY USING THE SAME, AND MODULATION METHOD

(75) Inventor: Yuichi Takagi, Kanagawa (JP)

(73) Assignee: Sony Corporation, Tokyo (JP)

( * ) Notice: Subject to any disclaimer, the term of this patent is extended or adjusted under 35 U.S.C. 154(b) by 62 days.

(21) Appl. No.: 09/838,380

(22) Filed: Apr. 20, 2001

(65) Prior Publication Data

US 2002/0012008 A1 Jan. 31, 2002

(30) Foreign Application Priority Data

Apr. 21, 2000 (JP) ..... 2000-126308

(51) Int. Cl.[7] ..... G09G 5/10
(52) U.S. Cl. ..... 345/690; 345/692; 345/82
(58) Field of Search ..... 345/690, 691, 345/692, 208, 210, 74.1, 75.1, 75.2, 76, 77, 82; 315/169.1, 169.3

(56) References Cited

U.S. PATENT DOCUMENTS 4,659,967 A * 4/1987 Dahl ..... 345/82
4,897,639 A * 1/1990 Kanayama ..... 345/82
5,757,348 A * 5/1998 Handschy et al. ..... 345/89
5,767,828 A * 6/1998 McKnight ..... 345/89
5,903,323 A * 5/1999 Ernstoff et al. ..... 345/691
5,936,597 A * 8/1999 Hyun et al. ..... 345/74.1
5,969,710 A * 10/1999 Doherty et al. ..... 345/693
6,023,259 A * 2/2000 Howard et al. ..... 345/82
6,288,695 B1 * 9/2001 Wood ..... 345/75.2
6,310,589 B1 * 10/2001 Nishigaki et al. ..... 345/82
6,472,946 B2 * 10/2002 Takagi ..... 345/82

* cited by examiner

*Primary Examiner*—Xiao Wu
(74) *Attorney, Agent, or Firm*—Rader, Fishman & Grauer PLLC; Ronald P. Kananen

(57) ABSTRACT

A modulation circuit capable of high resolution pulse width modulation while keeping down the bit length and an image display provided with the modulation circuit. By the A/D converter 4, the video signal Sv converted into a binary code having a preset bit length is divided into a plurality of binary codes by the controller 3 from the most significant bit to the least significant bit. Corresponding to the thus obtained plurality of divided binary codes, serial data is generated for producing a pulse current of a pulse width and current value according to the value of the binary code and is output to pulse width modulation circuits 1 cascade connected to the controller 3. The pulse width modulation circuits supply LEDs 3 of the pixels pulse currents of pulse widths and current values corresponding to the serial data.

8 Claims, 7 Drawing Sheets

MODULATION CIRCUIT, IMAGE DISPLAY USING THE SAME, AND MODULATION METHOD

BACKGROUND OF THE INVENTION

1. Field of the Invention

The present invention relates to a modulation circuit for generating and outputting a plurality of pulse signals at a predetermined period and an image display and a modulation method using the modulation circuit, more particularly relates to a modulation circuit of a driving signal for a light emitting diode (LED) or an organic electroluminescence (EL) element, and an image display comprising an LED or an organic EL element.

2. Description of the Related Art

Since the invention of the blue LED, LED color displays that use LEDs to form pictures by pixels emitting the three primary colors have been widely and generally fabricated. An LED is highly durable can be used semipermanently, so is optimal for long-term use outdoors. Therefore, LEDs have been extensively used for large-scale displays in stadiums and event sites and for information display panels or advertisements on sides of buildings and inside railway stations. In recent years, along with the increasing luminance and lower prices of blue LEDs, such LED color displays have been spreading rapidly.

FIG. 1 is a view of a drive circuit of an LED forming a pixel of an LED display.

In FIG. 1, reference numeral 100 indicates a drive circuit and 200 an LED. In addition, Spx represents a video signal supplied to an individual pixel, and Id a current flowing through the LED 200, respectively.

The drive circuit 100 outputs a current according to the video signal Spx to the LED 200, while the LED 200 emits light according to the supplied current. An LED display is comprised of exactly the same number of circuits consisting of the drive circuits 100 and LEDs shown in FIG. 6 as that of the pixels. By making the LEDs of the pixels emit light with luminances according to the video signals Spx supplied to the pixels, a person viewing the screen can recognize a picture. The video signal Spx supplied to each pixel is generally input to the drive circuit 100 as a digital value of a certain number of bits.

FIG. 2 is a view of the waveform of the current flowing through the LED 200 in FIG. 1.

In FIG. 2, the ordinate indicates the current flowing through the LED 200 by a relative value, while the abscissa indicates time by a relative value. In addition, Ipulse indicates the peak value of the waveform of the pulse-shaped current flowing through the LED, tw the time width of the pulse portion, and T the period of the waveform.

As shown in FIG. 2, the current flowing through the LED forming a pixel of an LED display has a periodic pulse-like waveform. The luminance is controlled by pulse width modulation to make the pulse width tw variable.

In principle, the current flowing through the LED is a direct current. It is possible to change the current value in accordance with the video signal Spx to adjust the luminance, but in this case, it is necessary to finely control the current value by the drive circuit. There is the disadvantage that the circuit for this control ends up increasing the number of parts. It is easier to increase the resolution of the time than the resolution of the current value, so in general the pulse width modulation system such as shown by the current waveform of FIG. 2 is adopted.

Due to the nature of human senses, the luminance of light blinking in a manner staying lit for less than 1/60 of a second is perceived to have a constant luminance. Therefore, even an LED is driven by a current of the waveform shown in FIG. 2, if the period T of the current is shorter than the aforesaid time, the blinking light from the LED can be made to be perceived by people as light of a constant luminance.

Further, generally, the magnitude of the luminance of an LED perceived by the human senses is proportional to the current flowing through the LED averaged over time. Therefore, the luminance changes in proportion with the duty of the pulse current.

The level of a video signal input to an LED display, however, is normalized in advance to match the luminance characteristics of a cathode ray tube (CRT). If such a video signal is input as it is to an LED, which has different luminance characteristics from a CRT pixel, the following problem arises.

FIG. 3 is a view of the relation of the luminances of an LED and CRT pixel with the level of an input signal.

In FIG. 3, the ordinate represents the luminance of an LED or CRT pixel by a relative value, while the abscissa represents the level of the signal input to an LED or a CRT pixel by a relative value. The curves indicated by A and B show the luminance characteristics of a CRT pixel and an LED, respectively.

Note that for the luminance characteristic A of a CRT pixel, the level of the video signal is expressed by voltage, while for the luminance characteristic B of an LED, the level of the video signal is expressed by the current flowing through the LED.

As shown in FIG. 3, the luminance of an LED has a linear relationship with the signal level, while the luminance of the CRT pixel has a nonlinear relationship with the signal level. In general, the luminance of a CRT pixel is proportional to the 2.2th power of the voltage level of the video signal. If a current proportional to a video signal normalized to match such a characteristic is directly supplied to an LED, the LED appears brighter than a CRT pixel in the region of low output of light, but appears darker than a CRT pixel in the region of high output of light. Consequently, a picture formed by such pixels has a ratio of luminance of the bright portions and dark portions different from the original picture, so looks unnatural to the viewer.

In order to solve this problem, in an LED display of the related art, a signal corrected to eliminate the influence due to the above luminance characteristic of the video signal is input to the drive circuit 100 as the above video signal Spx. Specifically, for example, when driving an LED of a linear luminance characteristic by a video signal produced to match with CRT pixel emitting light of a luminance proportional to the 2.2th power of the signal level, a signal proportional to the 2.2th power of the video signal is generated to drive the LED.

However, if the bit length of the original video signal is not sufficiently large, the binary data obtained by raising this digitalized image data to the 2.2th power is incapable of expressing fine changes of value in the region where the value of the original video signal is small. In other words, if the bit length of the digitalized video signal is small, the grey scale ends up rough in the low luminance region resulting in an unnatural picture. In order to avoid such a problem, it is necessary to increase the bit length of the video signal. Specifically, in an LED display of the related art, it is necessary to generate a video signal of a length of 12 to 16 bits to reproduce a picture which had been expressed by a video signal of a length of 8 bits in the case of a CRT. If the bit length of the video signal is increased in this way, the bit length of the pulse width modulation circuits for driving the LEDs also has to be increased, so the overall circuit scale becomes larger and the cost and power consumption rise.

Further, the pulse-like waveform shown in FIG. 2 is generally generated by counting a clock signal serving as a time reference. Increasing the bit length of a video signal means increasing the number of times to count the clock signal by that extent, so when using a clock signal of the same frequency, the period T of pulse width modulation ends up longer. For example, when generating and modulating the pulse width of a 12-bit video signal, 4 bits larger than an 8-bit video signal, and comparing them with the same frequency of the clock signal, the period T of pulse width modulation becomes 16 times that of an 8-bit video signal. Since the period T of pulse width modulation is set using the characteristic of the human senses described above, if this period is too long, "flickering" where the blinking of the light will be perceived by the human eye will be caused and the picture will become hard to view. Furthermore, this flickering by nature is more noticeable to the human eye in an LED display compared with a CRT, so the period T of pulse width modulation has to be several times higher than that of the usual refresh rate, for example, for example 1/50 of a seconds.

To increase the bit length of a video signal and shorten the period T of pulse width modulation, it is enough to increase the frequency of the clock signal used in the pulse width modulation circuit, but this has the disadvantage of increasing the power consumption of the circuit. Further, as it is difficult to further increase the current frequency of 10 to 20 MHZ 10 or more fold, there is a limit to increasing the frequency of the clock signal.

SUMMARY OF THE INVENTION

An object of the present invention is to provide a modulation circuit capable of high resolution pulse width modulation while keeping down the increase of the number of bits and an image display provided with the modulation circuit.

In order to achieve the above object, according to a first aspect of the present invention, there is provided a modulation circuit for outputting a pulse signal modulated according to a value of a binary code, comprising a selecting means for dividing the binary code from the most significant bit to the least significant bit into a plurality of binary codes and selecting and outputting the divided binary codes produced by this division in a preset order and a pulse outputting means for receiving the divided binary codes obtained from the selecting means and outputting a plurality of pulse signals having a pulse width and level corresponding to the divided binary codes by a predetermined period.

According to the modulation circuit of the present invention, the binary code for modulating the pulse signal is divided into a plurality of codes from the most significant bit to the least significant bit. The plurality of binary codes obtained by this division are defined as divided binary codes. These divided binary codes are selected and output to the pulse outputting means in a preset order by the selecting means. Then, the pulse outputting means generates and outputs a plurality of pulse signals having pulse widths and levels corresponding to the divided binary codes at a predetermined period.

Preferably, in the modulation circuit of the present invention, for each of the divided binary codes, the selecting means divides the predetermined period into a plurality of sub-frame periods of lengths corresponding to the bit lengths of the divided binary codes and selects and outputs the divided binary code corresponding to a sub-frame period in that sub-frame period.

According to the modulation circuit of the present invention employing the above configuration, the predetermined period is divided into a plurality of periods corresponding to the divided binary codes. The periods obtained by the division are defined as sub-frame periods. Each sub-frame period is set to have of a length corresponding to the bit length of the divided binary code corresponding to the sub-frame period. The divided binary codes are output by the selecting means to the pulse output means in the sub-frame periods corresponding to the divided binary codes.

Preferably, in the modulation circuit of the present invention, when the bit length of the i-th (i is a natural number) divided binary code from the least significant bit of the binary code is B(i) (B(i) is a natural number), the pulse outputting means sets the level of a pulse signal corresponding to the (i+1)-th divided binary code from the least significant bit of the binary code to a magnitude of 2 to the B(i) power ($2^{B(i)}$) times the level of the pulse signal corresponding to the i-th divided binary code.

According to the modulation circuit of the present invention employing the above configuration, the level of a pulse signal is set corresponding to the respective divided binary code. The level of a pulse signal is defined by the relation with the level of the pulse signal corresponding to the next lower divided binary code of the divided binary code corresponding to the pulse signal. That is, the level of a pulse signal corresponding to the (i+1)-th divided binary code from the least significant bit of the binary code is set to a magnitude of 2 to the B(i) power ($2^{B(i)}$) times the level of the pulse signal corresponding to the i-th divided binary code.

Preferably, in the modulation circuit of the present invention, there is provided a clock counting means for receiving clock pulses, counting the clock pulses from an initial value at the beginning of each sub-frame period, and outputting the clock count. The pulse outputting means detects the time when the magnitudes of the clock count and the value of the divided binary code invert and inverts the level of the pulse signal near this time.

According to the modulation circuit of the present invention employing the above configuration, the clock counting means counts the clock pulses from an initial value at the beginning of each sub-frame period. The pulse outputting means compares the obtained clock count output by the clock counting means and the value of the divided binary code and inverts the level of the pulse signal when the magnitude of the clock count and the value of the divided binary code invert.

According to a second aspect of the present invention, there is provided an image display comprising a selecting means for dividing a binary code into a plurality of binary codes from the most significant bit to the least significant bit and selecting and outputting the divided binary codes produced by the division in a preset order, a pulse outputting means for receiving the divided binary codes from the selecting means and outputting a plurality of the pulse signals having pulse widths and levels corresponding to the divided binary codes at a predetermined period, and light emitting elements emitting light of luminances corresponding to the levels of the pulse signals.

According to the image display of the present invention, the binary code for modulating the pulse signal is divided into a plurality of codes from the most significant bit to the least significant bit. The plurality of binary codes obtained by this division are defined as divided binary codes. These divided binary codes are selected and output to the pulse outputting means in a preset order by the selecting means. Then, the pulse outputting means generates and outputs a plurality of pulse signals having pulse widths and levels corresponding to the divided binary codes at a predetermined period. The pulse signals are input to the light emitting elements, then the light emitting diodes emit light at luminances corresponding to the levels of the pulse signals.

Preferably, in the image display of the present invention, for each of the divided binary codes, the selecting means divides the predetermined period into a plurality of sub-frame periods of lengths corresponding to the bit lengths of the divided binary codes and selects and outputs the divided binary code corresponding to a sub-frame period in that sub-frame period.

According to the image display of the present invention employing the above configuration, the predetermined period is divided into a plurality of periods corresponding to the divided binary codes. The periods obtained by the division are defined as sub-frame periods. Each sub-frame period is set to have of a length corresponding to the bit length of the divided binary code corresponding to the sub-frame period. The divided binary codes are output by the selecting means to the pulse output means in the sub-frame periods corresponding to the divided binary codes.

In the image display of the present invention, when the bit length of the i-th (i is a natural number) divided binary code from the least significant bit of the binary code is B(i) (B(i) is a natural number), the pulse outputting means sets the level of a pulse signal corresponding to the (i+1)-th divided binary code from the least significant bit of the binary code to a magnitude of 2 to the B(i) power ($2^{B(i)}$) times the level of the pulse signal corresponding to the i-th divided binary code.

According to the image display of the present invention employing the above configuration, the level of a pulse signal is set corresponding to the respective divided binary code. The level of a pulse signal is defined by the relation with the level of the pulse signal corresponding to the next lower divided binary code of the divided binary code corresponding to the pulse signal. That is, the level of a pulse signal corresponding to the (i+1)-th divided binary code from the least significant bit of the binary code is set to a magnitude of 2 to the B(i) power ($2^{B(i)}$) times the level of the pulse signal corresponding to the i-th divided binary code.

In the image display of the present invention, there is provided a clock counting means for receiving clock pulses, counting the clock pulses from an initial value at the beginning of each sub-frame period, and outputting the clock count. The pulse outputting means detects the time when the magnitudes of the clock count and the value of the divided binary code invert and inverts the level of the pulse signal near this time.

According to a third aspect of the present invention, there is provided a modulation method for dividing a binary code into a plurality of binary codes from the most significant bit to the least significant bit and generating a plurality of pulse signals modulated in accordance with the divided binary codes at a predetermined period, comprising a first step of selecting one of the plurality of divided binary codes and a second step of generating a pulse signal having a pulse width and level corresponding to the divided binary code selected in the first step in a period of a length according to the bit length of the divided binary code, wherein the first and the second steps are repeated in the predetermined period while selecting the divided binary codes in a preset order.

According to the modulation method of the present invention, the first step selects one of the divided binary codes obtained by dividing the binary code into a plurality of binary codes from the most significant bit to the least significant bit. The second step generates a pulse signal having a pulse width and level corresponding to the divided binary code selected in the first step in a period of a length according to the bit length of the divided binary code.

The first step selects the divided binary codes one by one in a predetermined order. Each time the first step selects a divided binary code, the second step generates a pulse signal according to the divided binary code selected at the first step. In this way, the first and the second steps are repeated in the predetermined period.

In the modulation method of the present invention, when the bit length of the i-th (i is a natural number) divided binary code from the least significant bit of the binary code is B(i) (B(i) is a natural number), the second step sets the level of a pulse signal corresponding to the (i+1)-th divided binary code from the least significant bit of the binary code to a magnitude of 2 to the B(i) power ($2^{B(i)}$) times the level of the pulse signal corresponding to the i-th divided binary code.

According to the modulation method of the present invention employing the above configuration, the second step sets the level of a pulse signal corresponding to the respective divided binary code. The level of a pulse signal is defined by the relation with the level of the pulse signal corresponding to the next lower divided binary code of the divided binary code corresponding to the pulse signal. That is, the level of a pulse signal corresponding to the (i+1)-th divided binary code from the least significant bit of the binary code is set to a magnitude of 2 to the B(i) power ($2^{B(i)}$) times the level of the pulse signal corresponding to the i-th divided binary code.

BRIEF DESCRIPTION OF THE DRAWINGS

These and other objects and features of the present invention will become clearer from the following description of the preferred embodiments given with reference to the accompanying drawings, in which.

DESCRIPTION OF THE PREFERRED EMBODIMENTS

Below, a description will be given of preferred embodiments of a modulation circuit and an image display of the present invention applied to an LED display with reference to the accompanying drawings.

Figure 4:
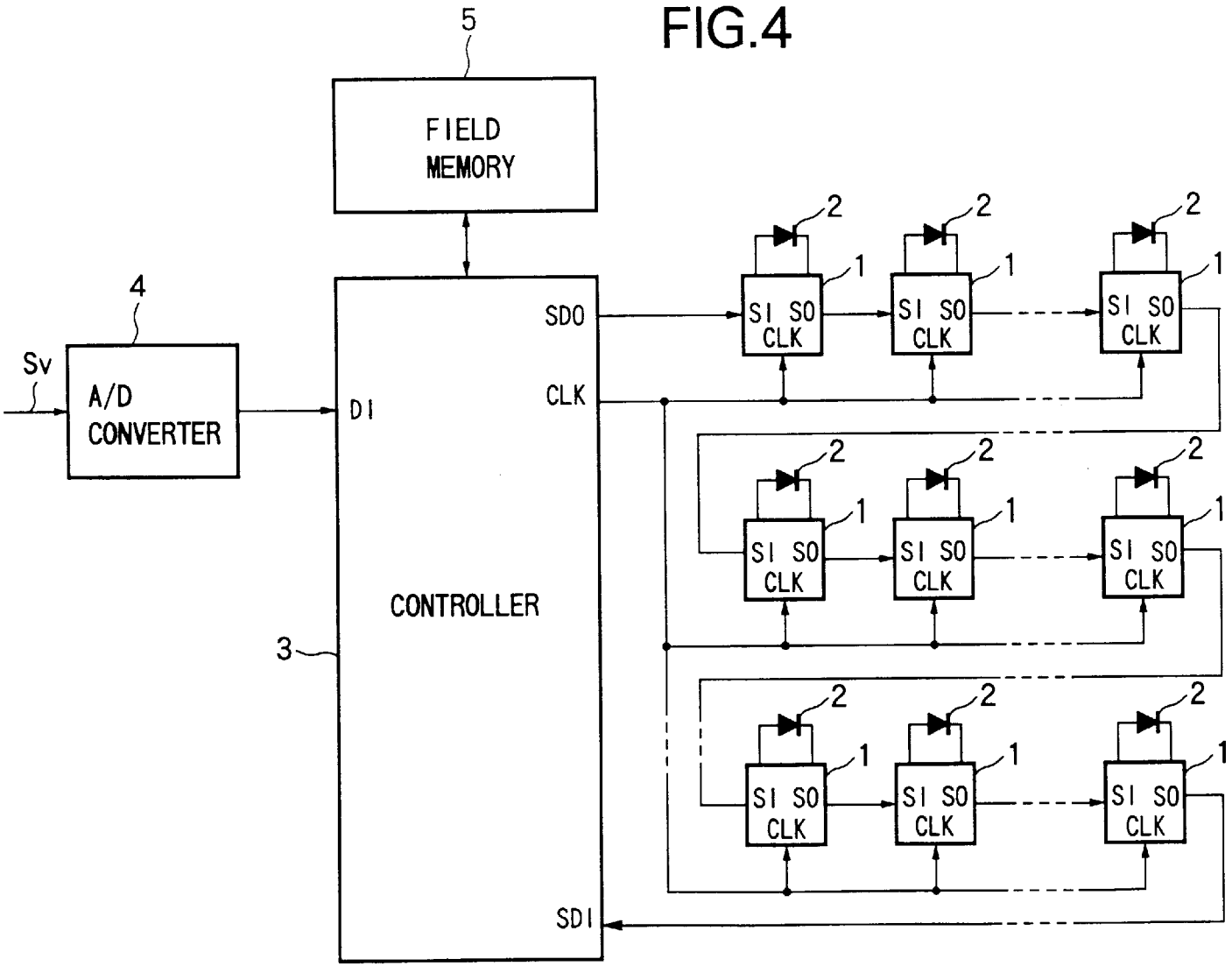
FIG. 4 is a block diagram of an LED display according to the present invention.

FIG. 4 is a block diagram of a drive circuit for an LED forming a pixel of an LED display.

In FIG. 4, numerals 1, 2, 3, 4, and 5 represent a pulse width modulation circuit, an LED, a controller, an A/D converter, and a field memory, respectively.

The pulse width modulation circuit 1 supplies a pulse current to an LED 2 on the basis of data of a pulse width and a current transmitted from an output terminal SDO of the controller 3. There is one pulse width modulation circuit for the LED of each pixel, the number of the pulse width modulation circuits is the same as that of the LEDs forming one screen.

The data of a pulse width and a current received by the pulse width modulation circuit 1 from the controller 3 is serial data and is received at a serial data input terminal SI. In addition, the pulse width modulation circuit 1 is provided with a serial data output terminal SO for outputting the data received from the input terminal SI given a certain delay. The output terminal SO is connected in cascade with the input SI of other pulse width modulation circuits. In this way, the serial data input terminal SI and serial data output terminal SO of the pulse width modulation circuit 1 are connected in cascade. By successively transmitting serial data from the input SI to the output terminal SO, data of the pulse width and current is transferred from the controller 3 to the pulse width modulation circuit 1. In FIG. 4, the last output terminal SO of the cascade connected pulse width modulation circuits 1 is connected to the controller 3. The controller 3 uses this returned signal to check the operational state of each pulse width modulation circuit 1.

Note that each pulse width modulation circuit 1 is provided with a clock input terminal CLK. The controller 3 supplies a common clock signal to each pulse width modulation circuit 1.

The controller 3 receives a digitalized video signal at the terminal D1 from the A/D converter 4. From this data, the controller 3 extracts data of luminance of each LED pixel and stores it in the field memory 5. The controller 3 further reads out data of each LED pixel from the field memory 5, converts it to serial data, and outputs it to pulse width modulation circuits 1 via the output terminal SDO. The serial data from the output terminal SDO is synchronized with the clock signal generated by the controller 3. This clock signal is output to all pulse width modulation circuits 1 through the clock output terminal CLK.

The input terminal SDI of the controller 3 receives serial data fed back from the pulse width modulation circuits 1. This serial data contains information on the operational states of the pulse width modulation circuits 1 (breakdowns of LEDs, overheating of ICs, etc.) According to this information, the controller 3 notifies the breakdown on a not illustrated display.

The A/D converter 4 converts the analog video signal Sv into binary codes of a preset bit length and outputs the data to the controller 3.

The field memory 5 temporarily stores the luminance data of each LED pixel extracted from the controller 3. The luminance data of each LED pixel is managed and stored one field by one (or one frame). The controller 3 reads out the luminance data one field by one and outputs it to the pulse width modulation circuits 1.

The analog video signal Sv is converted into binary codes of a preset bit length by the A/D converter 4 and is output to the controller 3. The controller 3 extracts the luminance data of each pixel and outputs it to the field memory 5. The field memory 5 temporarily stores the luminance data of each LED pixel one field by one. The controller 3 reads out the stored luminance data of pixels for forming one field at a specified time. By specified processing described in detail later, the data is converted into serial data and output to the pulse width modulation circuits 1.

According to the input luminance data of each pixel, the pulse width modulation circuits 1 supply pulse currents of a certain width and a certain peak value to the LEDs of pixels to light the LEDs and display a picture. A moving picture is displayed by repeating the operation of outputting luminance data of each field to the pulse width modulation circuits 1 and lighting the LEDs in the above way.

Note that the luminance data of the pixels was output to the pulse width modulation circuits 1 as serial data, but it may also be output as parallel data. In this case, there is the disadvantage that the number of wires increases with the bit length of the data, but there is also an advantage that the luminance data can be set into the pulse width modulation circuits 1 faster than serial data.

In addition, it is not necessary to store all of the data that forms one field in the field memory 5. For example, a horizontal period of data may be first stored in the memory as a buffer and then output. In addition, if the conversion time of the A/D converter 4 and the processing time of the controller 3 are sufficiently short, it is possible to convert data to serial data directly for output without using a buffer.

Below, the operation of a pulse width modulation circuit 1 will be described.

Figure 5:
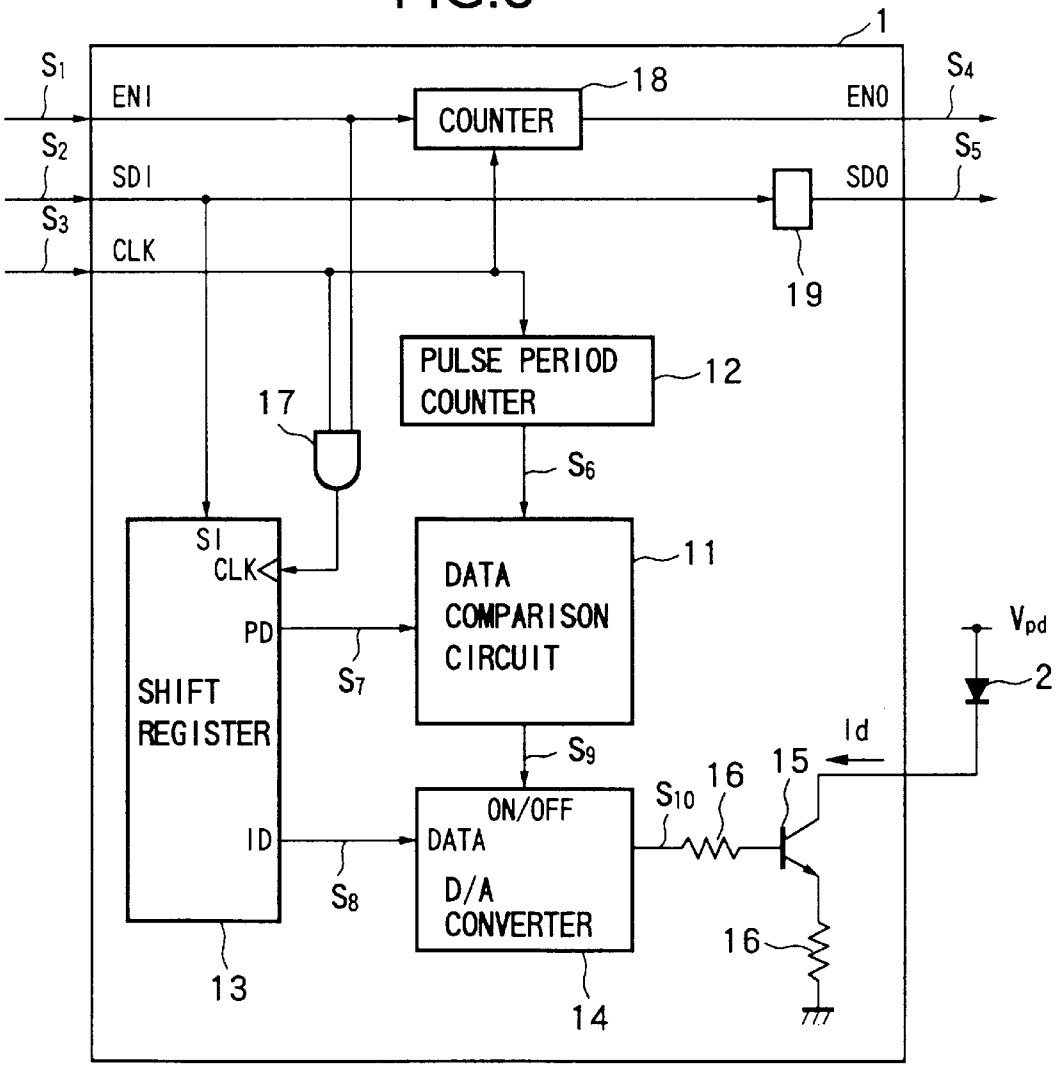
FIG. 5 is a block diagram for explaining the operation of a pulse width modulation circuit.

FIG. 5 is a block diagram for explaining the operation of a pulse width modulation circuit.

In FIG. 5, a data comparison circuit is represented by 11, a pulse period counter by 12, a shift register by 13, a D/A converter by 14, an npn transistor by 15, a resistance by 16, an AND circuit by 17, a counter by 18, and a delay circuit by 19.

The data comparison circuit 11 compares the pulse count S6 from the pulse period counter 12 and the luminance data S7 from the shift register 13 and outputs a signal S9 according to the result of comparison to the D/A converter 14 to control the ON/OFF state of the npn transistor 15. By the output signal S9 of the data comparison circuit 11, the pulse width of the current pulse through the LED 2 is controlled. The output signal S9 of the data comparison circuit 11 is reset when the enable signal S1 is at a high level. When the output signal S9 is reset, the npn transistor 15 turns OFF.

The pulse period counter 12 counts the clock of a signal S3 and outputs the count as a signal S6 to the data comparison circuit 11. The count of the pulse period counter 12 is reset when the enable signal S1 is at high level. Counting is started again after the enable signal S1 changes from a high level to low level and a certain number of clock signals are input.

The shift register 13 holds the serial data of the signal S2 transmitted from the controller 3 in an internal register in synchronization with the clock signal from the AND circuit 17 when the enable signal S1 is at high level. Further, after the enable signal S1 changes from a high level to low level and a certain number of clocks are input, the held data is output to the data comparison circuit 11 and the D/A converter 14. The serial data transmitted from the controller 3 contains data for setting pulse width and data for setting the peak value of a current. The shift register 13 outputs these data as signals S7 and S8 to the data comparison circuit 11 and the D/A converter 14, respectively.

The D/A converter 14 receives as input a signal S10 of a magnitude according to the value of the signal S8 from the shift register 13 at the base of the npn transistor 15 via the resistance 16. According to the magnitude of the voltage of the signal S10, the pulse current of the LED 2 is set.

In addition, the D/A converter 14 sets the ON/OFF state of the output signal S10 according to the signal S9 from the data comparison circuit 11. When the output signal S10 is set OFF, the voltage of the signal S10 is lowered to cut off the npn transistor 15. When the output signal S10 is set ON, the signal S10 of a magnitude according to the value of the signal S8 is output.

The npn transistor 15 supplies a pulse current to the LED 2 according to the output signal S10 of the D/A converter 14 received at its base via the resistance 16. Vpd represents the voltage supplied to the anode of the LED 2. The anodes of all LEDs 2 receive the same voltage Vpd. If the base current of the npn transistor 15 is variable according to the output signal S10 of the D/A converter 14, according to this base current, the collector current, namely, the current of the LED 2, is controlled.

The AND circuit 17 receives the enable signal S1 and the clock signal S3. When the enable signal S1 is at a high level, the clock signal S3 is output to the shift register 13.

The counter 18 is for generating the enable signal supplied to the cascade connected pulse width modulation circuits 1. After detecting a change of the level of the enable signal S1 from the high level to low level, an enable signal S4 of a preset clock length is output.

The delay circuit 19 output the serial data signal S5 by giving a delay of predetermined number of clocks to the input serial data signal S2. This delay is for synchronizing the enable signal S4 from the counter 18 with the serial data signal S5.

Figure 6:
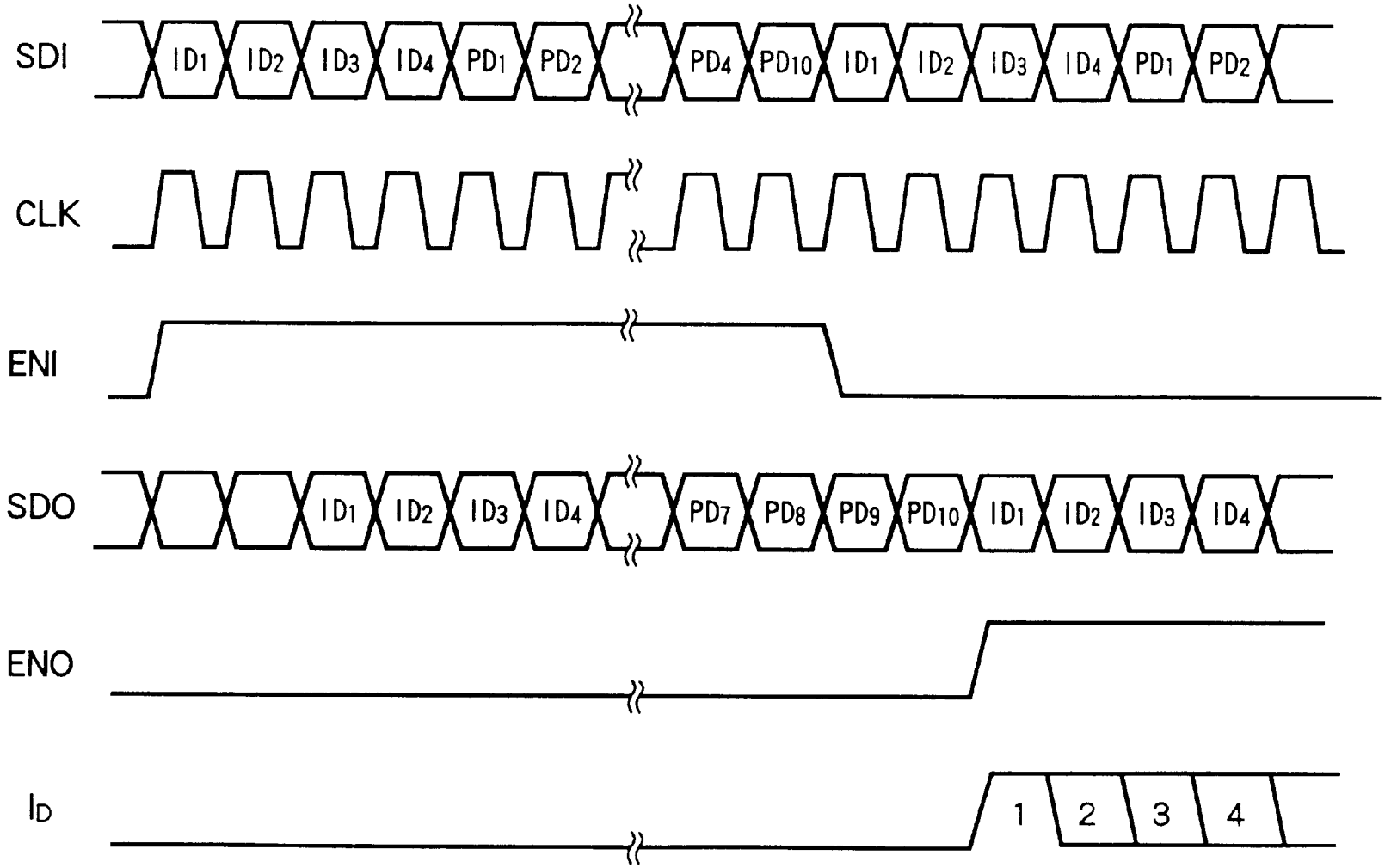
FIG. 6 is a time chart for explaining the operation of a pulse width modulation circuit.

FIG. 6 is a time chart for explaining the operation of a pulse width modulation circuit.

In FIG. 6, SDI stands for the serial data signal S2 input to the pulse width modulation circuits 1, CLK for the clock signal S3, ENI for the enable signal S5 input to the pulse width modulation circuits 1, SDO for the serial data output from the pulse width modulation circuits 1, ENO for the enable signal S5 input to the pulse width modulation circuits 1, and Id for the current flowing through the LED 2.

In FIG. 4, the signals output to the pulse width modulation circuits 1 from the terminal SDO of the controller 3 are equivalent to the enable signal S1 and serial signal S2 in FIG. 5. Among them, the serial data S2 contains data for setting the pulse width and data for setting the peak value of a current pulse. In FIG. 6, the bit length of the data for setting the value of a pulse current is set to four. The four bits are indicated by ID1 to ID4. Further, the bit length of the data for setting the pulse width is set to 10. The 10 bits are indicated by PD1 to PD10. Therefore, in FIG. 6, the word length of the serial data output from the controller 3 to the pulse width modulation circuit 1 is 14 bits.

Note that the bit lengths of the data for setting the pulse width and the data for setting the peak value of a current pulse are not limited to the example in FIG. 6 and may be set freely.

If the enable signal S1 changes to the high level in synchronization with the clock signal S1, both the count signal S6 from the pulse period counter 12 and the signal S9 from the data comparison circuit 11 are reset. When the enable signal S1 is at a high level, the data of the serial data signal S2 is synchronized with the clock signal from the AND circuit 17 and is input to the shift register 13. At this time, the pulse period counter 12 stops counting. Further, the output signal S10 of the D/A converter 14 is set OFF and no current flows through the LED2.

Figure 3:
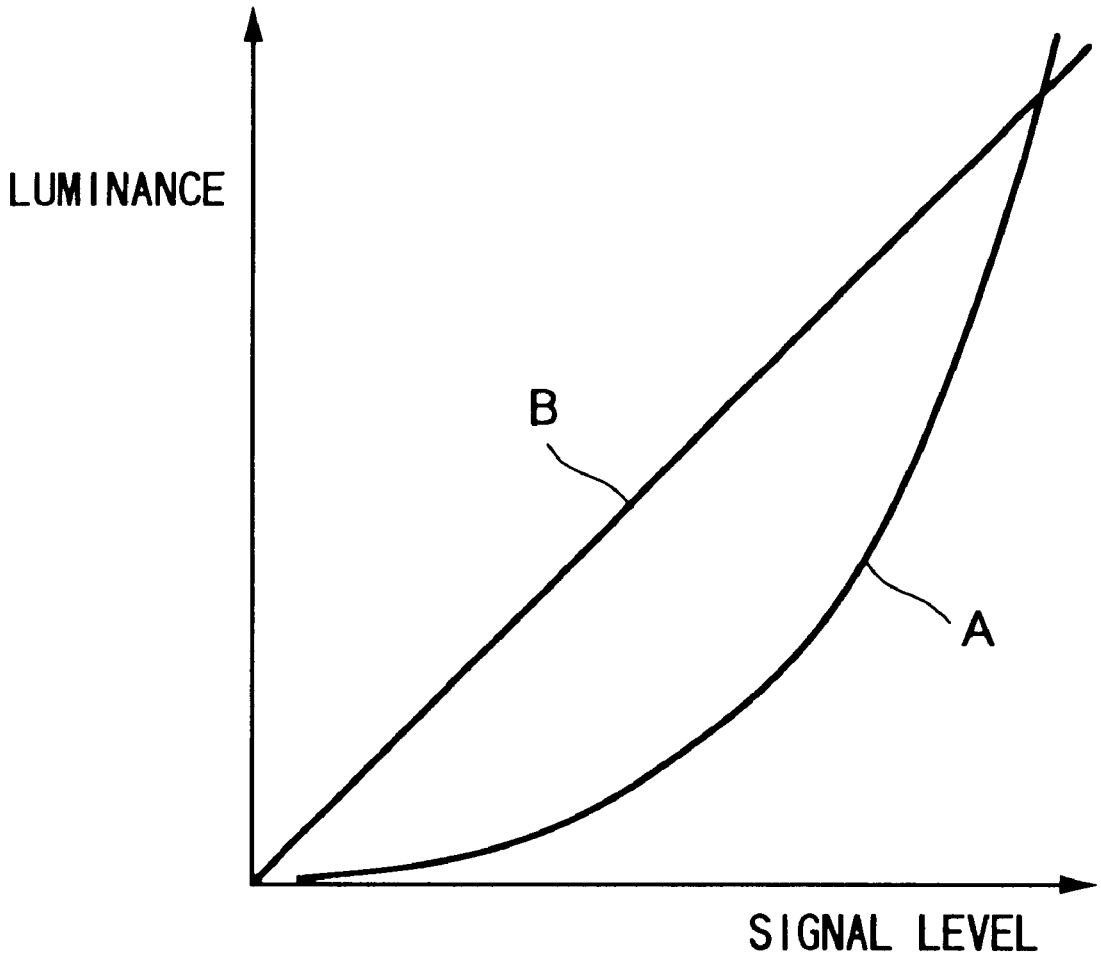
FIG. 3 is a view of the relationships of the luminance of an LED and CRT with the level of an input signal.

At the time when the setting of data to the shift register is finished, the enable signal S1 changes from a high level to low level. Then, if a preset number of clock signals (two in FIG. 3) are input, the pulse period counter 12 starts counting clocks. The count is reset when the enable signal S1 is at a high level, so the pulse period counter 12 starts counting from a preset initial value. At this time again, the output signal S10 of the D/A converter 14 is set to ON, and a current flows through the LED 2 to light the LED 2. The current value is set to a value according to the current value (ID1 to ID4) of the signal S8.

The count of the pulse period counter 12 increases with the input clock signal. When it exceeds the value of the data (PD1 to PD10) for setting the pulse width of the signal S7, the output signal S10 of the D/A converter 14 is set OFF by the output signal S9 of the data comparison circuit 11, and the current flowing through the LED 2 is stopped to cease light emission. Then, the pulse period counter 12 continues counting up to a maximum number corresponding to the total number of bits of the counter (in FIG. 6, the maximum number of 10 bits) and is reset, then starts counting from a preset initial value again. When the count is set back to an initial value and the pulse period counter 12 starts counting again, the LED 2 is supplied with a current again. When the count exceeds the value of the data for setting the pulse width, the current is cut off again. These operations are repeated. As a result, a current having a pulse width corresponding to the value of the data (PD1 to PD10) for setting the pulse width and a period corresponding to the bit length of the counter is supplied to the LED 2.

The output signal S4 changes from a low level to high level in synchronization with the change of the enable signal S1 from a high level to low level. When holding an enable signal of a high level, the output signal S4 is fixed to a predetermined number of clocks. In the example of FIG. 6, a high level signal of 14 clocks is generated and output by the counter 18.

The output signal S5 of the serial data is generated by delaying the input signal S2 of the serial data in the delay circuit 19 by a preset number of clocks (two clocks in the example of FIG. 6). The amount of delay is set so that the time when the enable output signal S4 changes to a high level coincides with the time when the leading data of the 14-bit serial data (ID1 in FIG. 6) appears as the signal 5. Due to this, the serial data passing through the other cascade connected pulse width modulation circuits 1 is stored in the shift register 13 of each pulse width modulation circuit 1 in the order of the cascade connection. Namely, the serial data first output is set in the shift register 13 of the pulse width modulation circuit 1 connected to the terminal SDO of the controller 3, while the serial data last output is set in the pulse width modulation circuit 1 connected to the terminal SDI.

As described above, the 14 bits of serial data including the current value data (ID1 to ID4) and the pulse width data (PD1 to PD10) are output from the controller 3 to the pulse width modulation circuits 1 and are held in registers of the pulse width modulation circuits 1. A current having a pulse width and a current value corresponding to the held data in the shift register 3 of each pulse width modulation circuit 1 is supplied to each LED 2.

The pulse width modulation circuit 1 shown in FIG. 5 is a circuit used when the current pulse data (pulse width and current value) output from the controller 3 to the pulse width modulation circuit 1 is serial data, but as described previously, in the present invention, the data transmitted from the controller 3 to the pulse width modulation circuits 1 is not limited to serial data. It may also be parallel data. In that case, it is possible to provide an address bus and a data bus and use a general transmission method of parallel data for setting pulse current data to a pulse width modulation circuit 1 of a specified address.

In addition, it is possible to change the D/A converter 14 and the npn transistor 15 to another current source that is able to supply a constant current to the LED 2. Further, it is possible to prepare a number of such kind of current sources and change to a circuit switching the current source connected to the LED 2 in accordance with the current data of the signal S8. By switching current sources, a small number of bits of the current data is enough. For example, when switching two current sources as with the pulse current of FIG. 8 described later, the minimum 1 bit is enough for the data of the current value.

Next, a description is given of the pulse current output from the controller 3 to the above pulse width modulation circuits 1.

Figure 7:
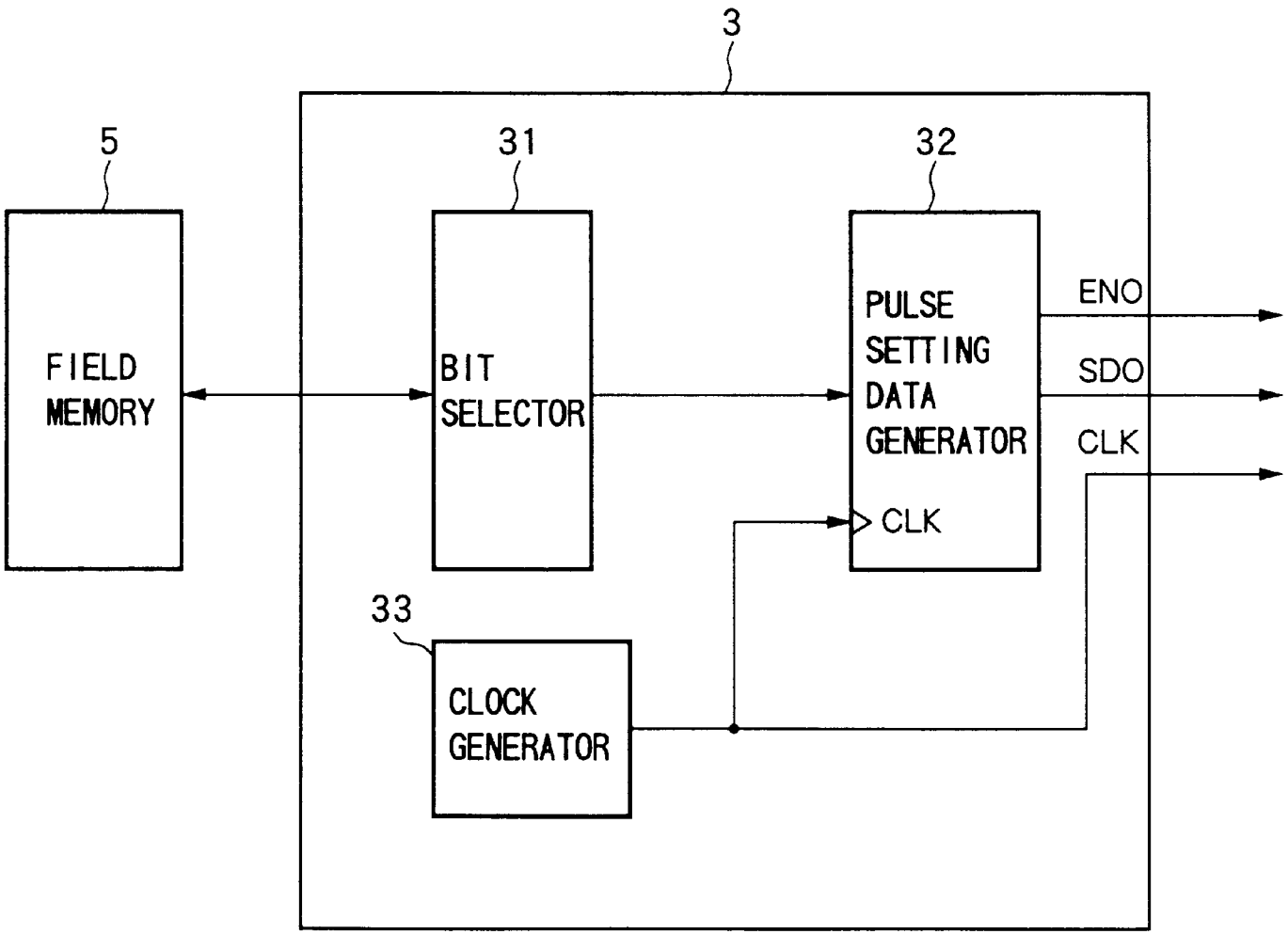
FIG. 7 is a block diagram for explaining the operation of a controller.

FIG. 7 is a block diagram for explaining the operation of the controller 3.

Figure 1:
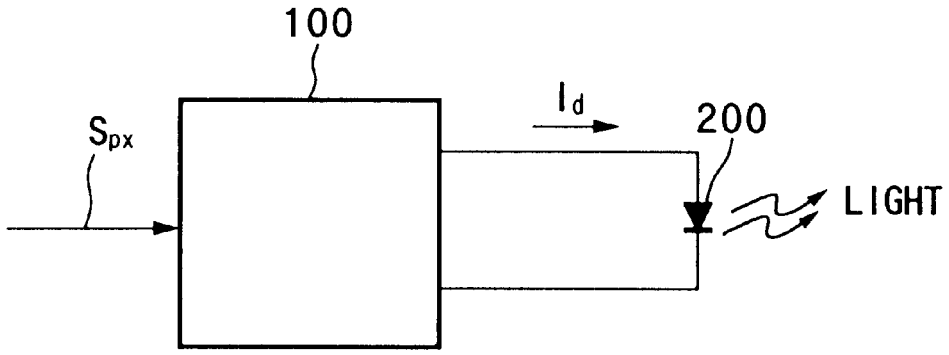
FIG. 1 is a schematic view of a drive circuit for an LED forming a pixel of an LED display.
Figure 2:
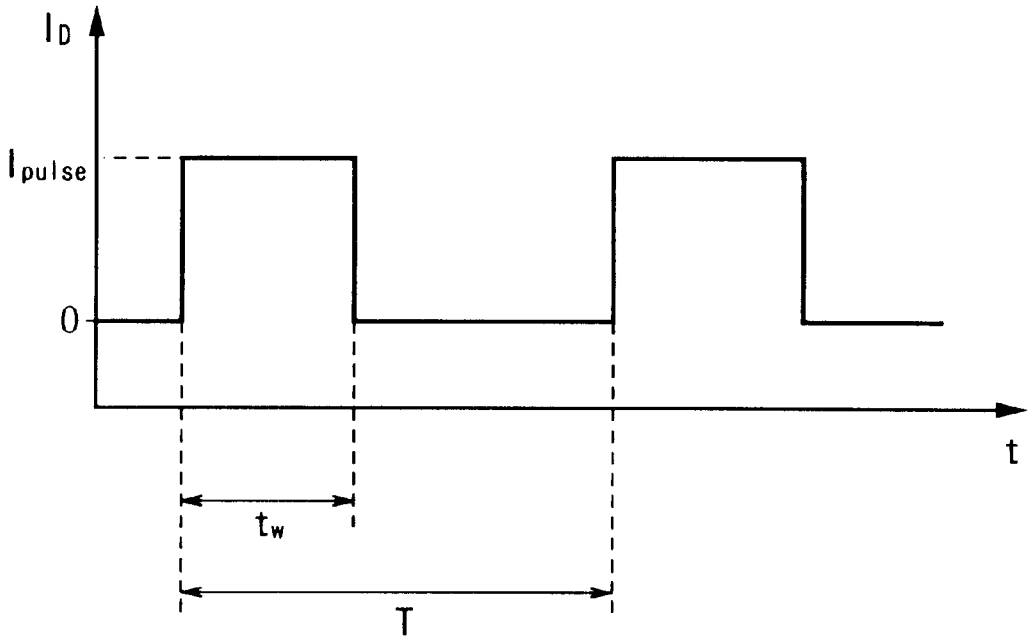
FIG. 2 is a view of a waveform of a current flowing through the LED in FIG. 4.

In FIG. 7, reference numerals 31, 32, and 33 represent a bit selector, a pulse setting data generator, and a clock generator, respectively. The same reference numerals are used for the same elements as in FIG. 4 and FIG. 1.

The bit selector 31 divides the binary code read out from the field memory 5, that is, the pixel luminance data, into low B1 bits and high B2 bits (B1, B2 are natural numbers), selects one of the divided data (hereinafter referred to as divided binary code), and outputs it to the pulse setting data generator 32. In the following description, as an example, B1 is set to four, B2 is set to 10. Accordingly, the luminance data digitalized by the A/D converter 4 and stored in the field memory 5 has 14 bits.

The pulse setting data generator 32 generates pulse width data (PD1 to PD10) based on the value of the divided binary code output from the bit selector 31 and generates current value data (ID1 to ID4) according to the type (B1 or B2) of the divided binary code output from the bit selector 31. The pulse setting data generator 32 converts this to serial data synchronized with the clock signal generated by the clock generator 33 and outputs it to the terminal SD0. An enable signal synchronized with the serial data is also generated and output to the terminal ENO.

The clock generator 33 supplies a clock signal to the pulse setting data generator 32. Further, it outputs a clock signal from the terminal CLK and supplies a clock signal to the pulse width modulation circuit 1.

Figure 8:
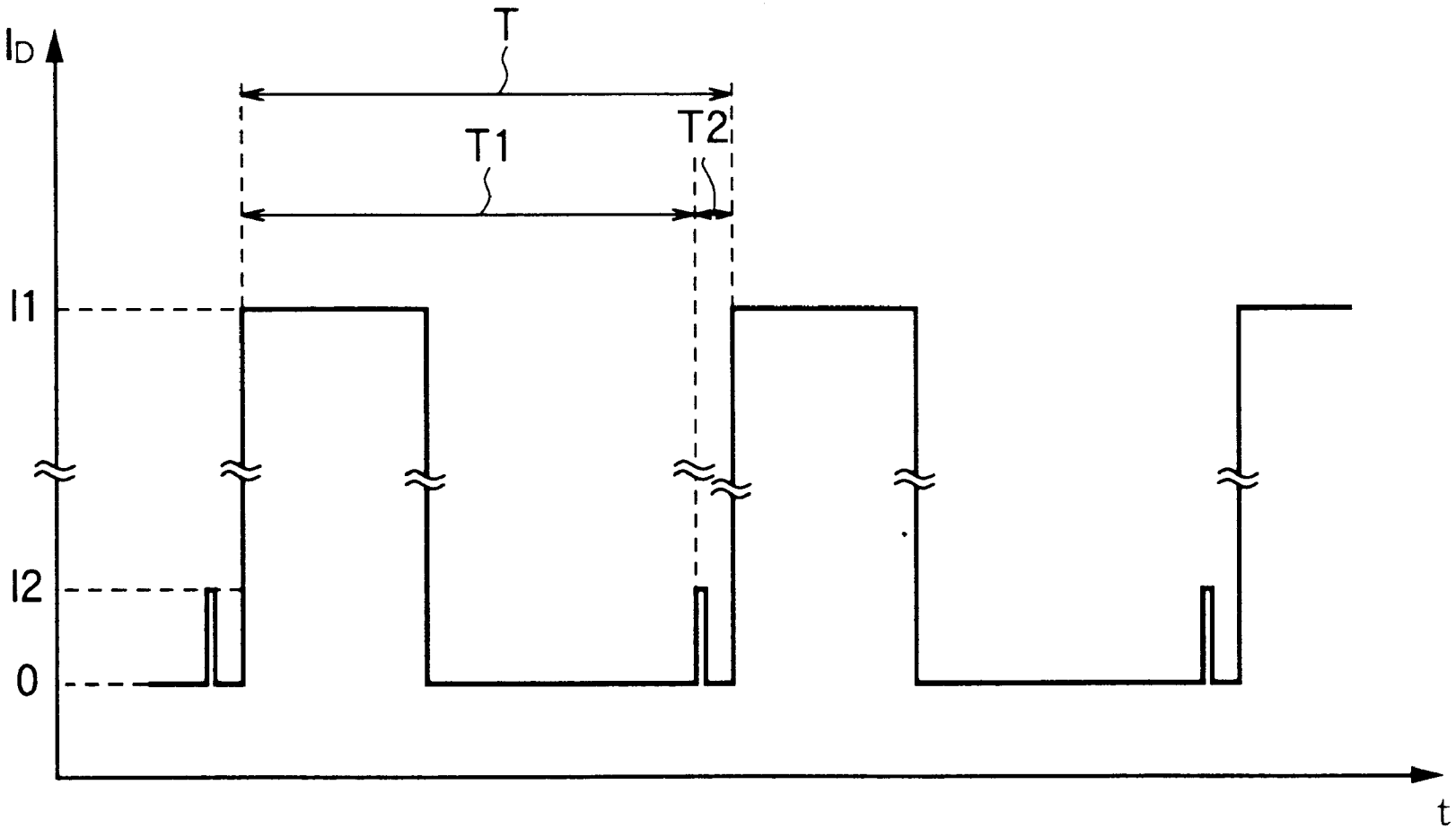
FIG. 8 is a view of a waveform of a pulse current flowing through the LED.

FIG. 8 is a view of a waveform of a pulse current flowing through the LED 2.

In FIG. 8, the ordinate and the abscissa indicate the current value and time. Further, T, T1, and T2 indicate the period of the current pulse and two sub-frame periods, respectively.

Sub-frame periods designate parts into which one period of the current pulse is divided. In each of these sub-frame periods, serial data is output from the controller 3 to each pulse width modulation circuits 1. In the example of FIG. 8, at the beginnings of the sub-frame periods T1 and T2, serial data is output. Namely, data are output twice in one period of the current pulse. Corresponding to the data, current pulses of different pulse widths and current values are supplied to the LED 2.

At the beginning of each sub-frame period, the serial data output from the pulse setting data generator 32 is generated according to the divided binary code output from the bit selector 31. For example, in FIG. 8, the pulse current in the sub-frame period T1 is generated from the divided binary code at the higher 10 bits of the original luminance data, and the pulse current in the sub-frame period T2 is generated from the divided binary code at the lower four bits of the original luminance data. That is, the bit selector 31 selects the divided binary codes at the higher 10 bits or the lower four bits and outputs them at the beginning of a sub-frame period to the pulse setting data generator 32.

The length of the sub-frame period T1 or the sub-frame period T2 is set according to the range of the value of the divided binary code selected by the bit selector 31 in either sub-frame period. As shown in FIG. 8, the length of the sub-frame period T2 in which the divided binary code selected by the bit selector 31 is at the higher 10 bits is set longer than the length of the sub-frame period T1 in which the selected divided binary code is at the lower four bits. This is because the range of the 10-bit divided binary code is larger than that of four-bit binary data.

For example, if the pulse width data determined by the selected 10-bit binary code in the sub-frame period T1 varies in the range from 0 to 1023, the sub-frame period T1 is set to have a length 1023 times the clock period. If the pulse width data determined by the selected 4-bit binary code in the sub-frame period T2 varies in the range from 0 to 15, the sub-frame period T2 is set to have a length 15 times the clock period.

Note that the sub-frame period may be freely set. For example, the sub-frame period T1 and the sub-frame period T2 can be set shorter than above lengths. When doing so, if the divided binary code is larger than a certain value, the sub-frame period becomes equal to the pulse width. As a result, the luminance of the LED becomes constant regardless of the divided binary code. Therefore, if the sub-frame period is shorter than the maximum length of the pulse width, part of the divided binary code becomes irrelevant to the luminance control.

Further, the sub-frame period may be set longer than the maximum length of the pulse width. For example, the sub-frame period T1 and the sub-frame period T2 can be set longer than above lengths. In this case, in a certain time interval within one period T, there is no current supplied even if setting a maximum luminance. In order to avoid flickering, it is desirable to shorten the time period without a current as much as possible.

The values of pulse currents supplied in different sub-frame periods are different. The current value of the pulse current generated according to the higher-bit divided binary code selected by the bit selector 31 is set to be a product of a factor determined by the bit length of the lower bits and the current value of the pulse current generated according to the lower-bit divided binary code. Specifically, if denoting the bit length of the lower bits as B1, the current value of the pulse current generated according to the higher bits is that of the pulse current generated according to the lower bits multiplied by 2 to the power B1. In FIG. 8, the current value I1 in the sub-frame period T1 is set to a product of 2 to the power 4 and the current value I2 in the sub-frame period T2, that is 16 times I2. The reason will be explained below.

As described previously, the LED luminance perceivable by the human senses is proportional to the current flowing through the LED averaged over time. Therefore, it is not required to set the current value of a pulse current constant, as in the conventional method for driving LEDs by means of pulse width modulation. In the present invention, both the pulse width and the current value of the pulse current may be variable. Even in this case, the luminance of an LED is equal to the current averaged over time. For example, consider the current waveform in FIG. 8. If the period T of the pulse current is constant, the timed-averaged current flowing through the LED2 is the same when the current I1 flows for a period of one clock and when the current I2 flows for a period of 16 clocks, so the luminance of the LEDs become the same.

Here, if defining the luminance due to the current I2 in one clock as 1, the luminance due to the current I1 in one clock is 16. Because the luminance data of the sub-frame period T2 is generated according to the lower four bits of the original luminance data, if the range of the pulse width is from 0 to 15 clocks, the range of the LED luminance due to the pulse current in the sub-frame period T2 is from 0 to 15 according to the above definition. On the other hand, the LED luminance due to the pulse current in the sub-frame period T1 is at least 16. Consequently, for example, according to the above definition, to set a luminance of 31, what should be done is just to set the pulse current in the sub-frame period T1 to have a pulse width of one clock and set the pulse current in the sub-frame period T2 to have a pulse width of 15 clocks. In addition, to set a luminance of 32, what needs to be done is just to set the pulse current in the sub-frame period T1 to have a pulse width of two clocks and set the pulse current in the sub-frame period T2 to have a pulse width of 0 clock, namely, no current.

As shown here, if setting the current values of two pulse currents so that the luminance of the case of adding one clock to the maximum value of the pulse width of the pulse current generated from the lower bits to raise the lower bits by one order becomes equal to the minimum luminance of the pulse current generated from the higher bits, an LED luminance can be set to have a resolution with a bit length corresponding to the original luminance data.

If denoting the bit length of the lower bits as B1, the number of clocks when the pulse width of the pulse current generated from the lower bits exceeds the maximum value and increases by one order becomes 2 to the power B1 clocks, so to make the luminance due to the pulse current of this pulse width equal to the minimum luminance of the pulse current generated from the higher bits, the luminance due to the pulse current of one clock generated from the higher bits should be equal to the luminance due to the pulse current of the 2 to the power B1 clocks generated from the lower bits. Therefore, the current value of the pulse current generated from the higher bits should be set to 2 to the power B1, times the current value of the pulse current generated from the lower bits.

In the explanation of the pulse current shown in FIG. 8, the explanation was made of the case of two sub-frame periods, but the number of sub-frame periods is not limited to two. When necessary it can be any number. For example, the period T of the pulse current may be divided into k sub-frame periods T1 to Tk (k is a natural number) and the luminance data can be divided into k parts as B1, bits to Bk bits from the least significant bits to the most significant bits. In this case, the sub-frame period T1 (i is a natural number less than or equal to k), preferably, is set to have a length of 2 to the power Bi clocks. Further, if representing the current value of the pulse current in the sub-frame period T1 as Ii, preferably the current value Ii+1 is set to be Ii multiplied by 2 to the power Bi.

The Bi-bit divided binary code selected by the bit selector 31 is output at the beginning of the sub-frame period Ti. The order in which the B1 to Bk divided binary codes are selected by the bit selector 31 need not be from the most significant bit to the least significant bit as in the example of FIG. 8. It may be any order.

In the pulse setting data generator 32, data of the pulse width is generated from the value of the Bi-bit divided binary code input from the bit selector 31. In addition, data of the current value multiplied by a factor corresponding to the type (B1 to Bk) of the divided binary code is also generated. The generated data of pulse width and current value is converted into serial data synchronized with the clock signal from the clock generator 33 and is output from the terminal SDO to the pulse width modulation circuits 1.

The serial data output from the pulse setting data generator 32 is stored in the shift registers of the pulse width modulation circuits 1 cascade connected to the terminal SDO. Based on the stored data, pulse current is supplied to the LEDs 2.

The bit selector 31 and the pulse setting data generator 32 repeat the above operations k times from i=1 to i=k within one period of the pulse current.

As described above, according to the image display of the present invention, in the controller 3, the binary code, that is, the luminance data, is divided into a plurality of divided binary codes from the most significant bit to the least significant bit and these divided binary codes are selected and output in a preset order. Pulse width modulation circuits 1 receive the divided binary data output from the controller 3 and supply a plurality of pulse currents having pulse widths and current values corresponding to the divided binary codes to LEDs at a predetermined period. Therefore, it is enough for the bit length of the data processed in the counters and shift registers of the pulse width modulation circuits 1 to be larger than the maximum bit lengths of these divided binary codes and to be smaller than that of the original luminance data that is divided. Therefore the circuit scale can be reduced, thereby leading to lower cost in circuits, a smaller size of the apparatus, and a lower power consumption.

In addition, corresponding to the above divided binary codes, the period of the pulse current is divided into a number of sub-frame periods each having a length according to the bit length of each divided binary code. In each sub-frame period, the divided binary code corresponding to the sub-frame period is selected and is output from the controller 3, so when performing pulse width modulation using luminance data of the same bit length and a clock signal of the same period, in the present invention, the period of the pulse current can be made shorter compared with conventional method in which the current value of the pulse current is constant and only the pulse width is variable. For example, in order to obtain the same luminance resolution using the same clock period as the pulse current in FIG. 8, in the related art, two to the 14th power clocks, namely, 16384 clocks are required. In contrast, in the present invention, the period of the sum of the sub-frame period T1 and the sub-frame period T2 is enough, that is, the sum of 1023 clocks and 16 clocks is enough. In other words, according to the present invention, in this example, the period of the pulse current can be shortened to 1/16. Consequently, both a high luminance resolution and reduction of flicker are achieved.

Further, if denoting as B(i) the bit length of the i-th divided binary code from the lower bits of the luminance data, the current value of the pulse current related to the (i+1)-th divided binary code from the lower bits of the luminance data is that of the pulse current according to the i-th divided binary code multiplied by 2 to the power B1. Therefore, while the bit length of data in the pulse width modulation circuits 1 can be reduced, the LED luminance can be set to have the resolution obtained with the bit length of the original luminance data.

The present invention is not limited to driving the current of an LED. For example, it may also be applied to the drive circuit of an organic EL element. Further, in general, it is applicable to other electric appliances making use of the average of pulse signals over time. In these applications as well, the same effects as the case of driving the current of an LED can be obtained. Namely, the circuit scale of a pulse width modulation circuit can be reduced. This results in a lower cost in circuit, smaller size of the apparatus, and lower power consumption. Further, while the bit length of data in the pulse width modulation circuits is reduced, it is possible to set the time average of pulse signals at a high resolution. Furthermore, because the period of the pulse signal can be shortened, a lower frequency oscillation component appearing when the pulse signal is smoothed by a low-pass filter can be reduced.

Summarizing the effects of the present invention, according to the modulation circuit of the present invention, the bit length of a binary code necessary for pulse width modulation can be reduced. In addition, it is possible to set the average of pulse signals over time at a resolution higher than a binary code necessary for pulse width modulation. Further, the period of the pulse signal can be shortened.

According to the image display of the present invention, because the bit length of a binary code necessary for pulse width modulation can be reduced, the circuit scale can be reduced. In addition, a resolution higher than a binary code necessary for pulse width modulation can be obtained. Further, since the refresh rate can be increased, reduction of flicker is achievable.

According to the modulation method of the present invention, the bit length of a binary code necessary for pulse width modulation can be reduced. In addition, it is possible to set the average of pulse signals over time at a resolution higher than a binary code necessary for pulse width modulation. Further, the period of the pulse signal can be shortened.

What is claimed is:

1. A modulation circuit for outputting pulse signals modulated according to a value of a binary code, comprising:

a selecting means for dividing the binary code from the most significant bit to least significant bit into a plurality of parts, and selecting and outputting the therefore obtained divided binary codes in a preset order; and a pulse outputting means for receiving the divided binary codes from the selecting means, and outputting a plurality of said pulse signals of a predetermined period each having a pulse width and a level corresponding to one of the divided binary codes;

wherein for each of the divided binary codes, the selecting means divides the predetermined period into a plurality of sub-frame periods of lengths corresponding to the bit lengths of the divided binary codes and selects and outputs the divided binary code corresponding to a sub-frame period in that sub-frame period; and further comprising a clock counting means for receiving clock pulses, counting the clock pulses from an initial value at the beginning of each sub-frame period, and outputting the clock count, wherein the pulse outputting means detects the time when the magnitudes of the clock count and the value of the divided binary code invert and inverts the level of the pulse signal near this time.

2. A modulation circuit for outputting pulse signals modulated according to a value of a binary code, comprising:

a selecting means for dividing the binary code from the most significant bit to least significant bit into a plurality of parts, and selecting and outputting the therefore obtained divided binary codes in a preset order; and a pulse outputting means for receiving the divided binary codes from the selecting means, and outputting a plurality of said pulse signals of a predetermined period each having a pulse width and a level corresponding to one of the divided binary codes;

wherein for each of the divided binary codes, the selecting means divides the predetermined period into a plurality of sub-frame periods of lengths corresponding to the bit lengths of the divided binary codes and selects and outputs the divided binary code corresponding to a sub-frame period in that sub-frame period; and wherein when the bit length of the i-th (i is a natural number) divided binary code from the least significant bit of the binary code is B(i) (B(i) is a natural number), the pulse outputting means sets the level of a pulse signal corresponding to the (i+1)-th divided binary code from the least significant bit of the binary code to a magnitude of 2 to the B(i) power (2B(i)) times the level of the pulse signal corresponding to the i-th divided binary code;

further comprising a clock counting means for receiving clock pulses, counting the clock pulses from an initial value at the beginning of each sub-frame period, and outputting the clock count, wherein the pulse outputting means detects the time when the magnitudes of the clock count and the value of the divided binary code invert and inverts the level of the pulse signal near this time.

3. An image display including light emitting diodes, each LED receiving pulse signals modulated according to a value of a binary code and emit light of luminances corresponding to the levels of the pulse signals, comprising:

a selecting means for dividing a binary code into a plurality of binary codes from the most significant bit to the least significant bit and selecting and outputting the divided binary codes produced by the division in a preset order and a pulse outputting means for receiving the divided binary codes from the selecting means and outputting a plurality of the pulse signals having pulse widths and levels corresponding to the divided binary codes at a predetermined period;

wherein the selecting means and the pulse outputting means are part of a modulation circuit that separates at least lower bit group and higher bit group to generate the modulated pulse signals; and wherein each LED is serially connected and each LED is electrically connected to its own modulation circuit.

4. An image display as set forth in claim 3, wherein for each of the divided binary codes, the selecting means divides the predetermined period into a plurality of sub-frame periods of lengths corresponding to the bit lengths of the divided binary codes and selects and outputs the divided binary code corresponding to a sub-frame period in that sub-frame period.

5. An image display as set forth in claim 3, wherein when the bit length of the i-th (i is a natural number) divided binary code from the least significant bit of the binary code is B(i) (B(i) is a natural number), the pulse outputting means sets the level of a pulse signal corresponding to the (i+1)-th divided binary code from the least significant bit of the binary code to a magnitude of 2 to the B(i) power ($2^{B(i)}$) times the level of the pulse signal corresponding to the i-th divided binary code.

6. An image display as set forth in claim 4, wherein when the bit length of the i-th (i is a natural number) divided binary code from the least significant bit of the binary code is B(i) (B(i) is a natural number), the pulse outputting means sets the level of a pulse signal corresponding to the (i+1)-th divided binary code from the least significant bit of the binary code to a magnitude of 2 to the B(i) power ($2^{B(i)}$) times the level of the pulse signal corresponding to the i-th divided binary code.

7. An image display including light emitting elements which receive pulse signals modulated according to a value of a binary code and emit light of luminances corresponding to the levels of the pulse signals, comprising:

a selecting means for dividing a binary code into a plurality of binary codes from the most significant bit to the least significant bit and selecting and outputting the divided binary codes produced by the division in a preset order and a pulse outputting means for receiving the divided binary codes from the selecting means and outputting a plurality of the pulse signals having pulse widths and levels corresponding to the divided binary codes at a predetermined period wherein for each of the divided binary codes, the selecting means divides the predetermined period into a plurality of sub-frame periods of lengths corresponding to the bit lengths of the divided binary codes and selects and outputs the divided binary code corresponding to a sub-frame period in that sub-frame period;

further comprising a clock counting means for receiving clock pulses, counting the clock pulses from an initial value at the beginning of each sub-frame period, and outputting the clock count, wherein the pulse outputting means detects the time when the magnitudes of the clock count and the value of the divided binary code invert and inverts the level of the pulse signal near this time.

8. An image display including light emitting elements which receive pulse signals modulated according to a value of a binary code and emit light of luminances corresponding to the levels of the pulse signals, comprising:

a selecting means for dividing a binary code into a plurality of binary codes from the most significant bit to the least significant bit and selecting and outputting the divided binary codes produced by the division in a preset order, and a pulse outputting means for receiving the divided binary codes from the selecting means and outputting a plurality of the pulse signals having pulse widths and levels corresponding to the divided binary codes at a predetermined period;

wherein for each of the divided binary codes, the selecting means divides the predetermined period into a plurality of sub-frame periods of lengths corresponding to the bit lengths of the divided binary codes and selects and outputs the divided binary code corresponding to a sub-frame period in that sub-frame period; and wherein when the bit length of the i-th (i is a natural number) divided binary code from the least significant bit of the binary code is B(i) (B(i) is a natural number), the pulse outputting means sets the level of a pulse signal corresponding to the (i+1)-th divided binary code from the least significant bit of the binary code to a magnitude of 2 to the B(i) power (2B(i)) times the level of the pulse signal corresponding to the i-th divided binary code;

further comprising a clock counting means for receiving clock pulses, counting the clock pulses from an initial value at the beginning of each sub-frame period, and outputting the clock count, wherein the pulse outputting means detects the time when the magnitudes of the clock count and the value of the divided binary code invert and inverts the level of the pulse signal near this time.

* * * * *